United States Patent [19]

Yamagami et al.

[11] Patent Number: 4,558,000

[45] Date of Patent: Dec. 10, 1985

[54] COLOR REVERSAL LIGHT-SENSITIVE MATERIAL

[75] Inventors: Hiroyuki Yamagami; Yasuhiro Hayashi; Naoyasu Deguchi; Kiyoshi Imai, all of Kanagawa, Japan

[73] Assignee: Fuji Photo Film Co., Ltd., Kanagawa, Japan

[21] Appl. No.: 590,398

[22] Filed: Mar. 16, 1984

[30] Foreign Application Priority Data

Mar. 16, 1983 [JP] Japan ..... 58-43859

[51] Int. Cl.[4] ..... G03C 1/46

[52] U.S. Cl. ..... 430/504; 430/379; 430/407; 430/551; 430/578; 430/614

[58] Field of Search ..... 430/379, 407, 578, 614, 430/504, 551

[56] References Cited

U.S. PATENT DOCUMENTS

| | | | |
|---|---|---|---|
| 3,520,689 | 7/1970 | Nagae et al. | 430/379 |
| 3,622,339 | 11/1971 | Nishio et al. | 430/609 |
| 3,728,121 | 4/1973 | Zorn et al. | 430/379 |
| 4,276,372 | 6/1981 | Wernicke et al. | 430/379 |

*Primary Examiner*—J. Travis Brown

*Attorney, Agent, or Firm*—Sughrue, Mion, Zinn, Macpeak & Seas

[57] ABSTRACT

A color reversal light-sensitive material comprising a support having coated thereon at least a pair of silver halide emulsion layers having mutually different color sensitivities and consisting of an emulsion having a high silver/coupler ratio and an emulsion having a low silver/coupler ratio, the former ratio being greater by a factor of at least 5 than the latter ratio, and the latter emulsion being incorporated with a compound containing recurring units represented by the following General Formula (I):

(I)

the substituents being defined within the specification. By including the compound of the general formula (I) within the particular emulsion layer which is highly susceptible to changes in sensitivity and maximum density, it is possible to prevent deterioration in color balance which has been found to be due to variation in the concentration of potassium bromide.

12 Claims, No Drawings

COLOR REVERSAL LIGHT-SENSITIVE MATERIAL

FIELD OF THE INVENTION

The present invention relates to a color reversal light-sensitive material. In particular, it relates to a color reversal light-sensitive material which is virtually prevented from color balance deterioration due to variations in the concentration of potassium bromide contained in the first developer for the color reversal processing thereof.

BACKGROUND OF THE INVENTION

Conventional color reversal light-sensitive materials comprise a support having thereon at least two silver halide emulsion layers having mutually different color sensitivities. Each of these emulsion layers is incorporated with a color-forming coupler capable of forming a color image with a color complementary to the color corresponding to wavelength in light to which the emulsion layer per se is sensitive. (The term "color sensitivity" herein means a property capable of being sensitive to light in either red, green or blue region of the visible spectrum.)

More conventional types of color reversal light-sensitive materials possess a layer structure comprising, in order, a support, a red-sensitive silver halide emulsion layer comprising a silver halide sensitized with a red-sensitizing dye and a coupler capable of forming a cyan dye image, an interlayer, a green-sensitive silver halide emulsion layer comprising a silver halide sensitized with a green-sensitizing dye and a coupler capable of forming a magenta dye image, an interlayer (yellow filter layer, in many cases), a blue-sensitive silver halide emulsion layer sensitive to light in the blue region of the spectrum and containing a coupler capable of forming a yellow dye image. Each of the emulsion layers may be composed of a low sensitive (or slow speed) layer and a high sensitive (or high speed) layer which have an identical color sensitivity.

In such color light-sensitive materials, the molar ratio of silver halide to the coupler (hereinafter referred to as silver/coupler ratio) contained in each silver halide emulsion layer does not always vary widely from layer having one color sensitivity to layer having different color sensitivity thereto. In some cases, however, a certain emulsion layer (in particular, a green-sensitive emulsion layer) is intentionally endowed with a silver/-coupler ratio greater than those of other layers having different color sensitivities, so as to improve the graininess of dye images to be formed in said emulsion layer.

The present inventors have now discovered that migration, during storage, of a sensitizing dye (e.g., a red-sensitizing dye) from an emulsion layer to other emulsion layers having different color sensitivities can be effectively prevented by incorporating silver halide grains having been previously fogged on their surfaces (hereinafter referred to as fogged silver halide grains) into an interlayer, in particular, into an interlayer between a green-sensitive emulsion layer and a red-sensitive emulsion layer.

In light-sensitive materials comprising an interlayer which contains fogged silver halide grains, silver halide emulsion layers adjacent to the interlayer tend to fog. Consequently, not only lowered maximum densities but also deterioration in gradation may result when such light-sensitive materials are subjected to a color reversal processing. The above problem can be solved by the provision of an interlayer not containing fogged silver halide grains (hereinafter referred to as fog prevention layer) between the interlayer containing fogged silver halide grains and a silver halide emulsion layer which is adjacent thereto. However, this technique, when applied to both green- and red-sensitive emulsion layers in a light-sensitive material, brings about an undesirable increase in the thickness of coated films and, as a result, deterioration in the sharpness of images. It is therefore preferable to prevent fogs in at least one of the two layers by a means other than the provision of such a fog prevention layer. According to investigations by the present inventors, the above problem can be solved effectively by raising the silver/coupler ratio (based on moles) in silver halide emulsion layers adjacent to said interlayer in which the fogged silver halide grains are contained, so as to compensate the reduction in the amount of silver caused by said fogs.

However, when a silver halide emulsion having a high silver/coupler ratio is applied to a photographic light-sensitive material in order to improve graininess and/or to compensate the reduction in silver amount of silver caused by said fogs, such a silver halide emulsion layer shows an markedly decreased change in its sensitivity against the variation in the concentration of potassium bromide contained in the first developer used for the color reversal processing thereof, in comparison with those changes in other emulsion layers. Although this phenomenon may seem to be advantageous, it could cause a problem with regard to color balance. In other words, when a light-sensitive material comprising such a silver halide emulsion layer is treated with an exhausted first developer, there would result a deteriorated color balance between such an emulsion layer and other emulsion layers. This phenomenon becomes conspicuous in such cases where silver/coupler ratio in a silver halide emulsion layer is greater by a factor of at least 5, in particular, by a factor of at least 10, than those ratios in other silver halide emulsion layers having different color sensitivities. This kind of problem will not occur with a light-sensitive material in which all the emulsion layers are provided with high silver/coupler ratios. However, such a light-sensitive material would be impracticably costly and require a prolonged period of time in the desilvering step of the color reversal processing thereof.

Generally, because the concentration of potassium bromide contained in the first developer of color reversal processing varies depending upon degree of exhaustion of processing solution, it is practically useful to provide color reversal light-sensitive material which is prevented from deterioration in color balance due to the variation in the concentration of potassium bromide contained in the first developer of color reversal processing.

SUMMARY OF THE INVENTION

It is therefore an object of the invention to provide a color reversal light-sensitive material which is virtually prevented from deterioration in color balance due to the variation in the concentration of potassium bromide contained in the first developer of color reversal processing.

The present inventors have conducted intensive investigations for years on the prevention of deterioration in color balance due to said variation in the concentration of potassium bromide and, as a result, found that the deterioration can be effectively prevented by incorporating a certain kind of compound into an emulsion layer which is highly susceptible to changes in its sensitivity and maximum density caused by said variation.

Accordingly, there is provided by the invention a color reversal light-sensitive material comprising a support having coated thereon at least a pair of silver halide emulsion layers having mutually different color sensitivities and consisted of an emulsion with a high silver/-coupler ratio and an emulsion with a low silver/coupler ratio, the former ratio being greater by a factor of at least 5 than the latter ratio, and the latter emulsion being incorporated with a compound containing recurring units represented by the following General Formula (I):

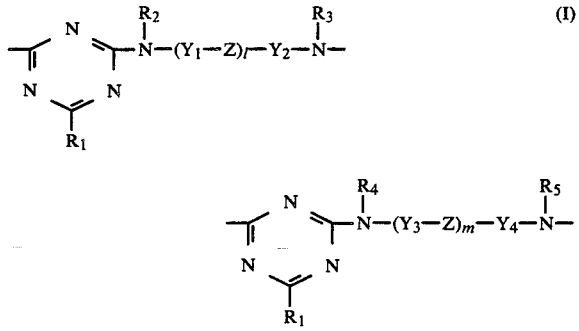

(I)

wherein:

$R_1$ represents —OR, —SR or

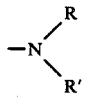

(in which R and R' each represents a hydrogen atom, an alkyl, aryl, aralkyl, cycloalkyl or heterocyclic group which may be substituted, or R and R' in combination may form a heterocyclic ring which may contain an —O— group);

$R_2$, $R_3$, $R_4$ and $R_5$ each represents a hydrogen atom or an alkyl group which may be substituted;

$Y_1$, $Y_2$, $Y_3$ and $Y_4$ each represents a polymethylene group which may be substituted, an aryl group which may be substituted or a cycloalkylene group;

Z represents —O—, —$SO_2$— or —$CH_2$—; and l and m represents 0 or an integer of 1.

DETAILED DESCRIPTION OF THE INVENTION

Preferable compounds having recurring units represented by the above-described General Formula (I) are those wherein:

$R_1$ is —OR, —SR or

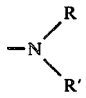

(in which R and R' each is a hydrogen atom, an alkyl, hydroxyalkyl, sulfoalkyl (or the salt thereof), carboxyalkyl (or the salt thereof), aralkyl, or cycloalkyl group each having up to 12 carbon atoms, a 5- or 6-membered heterocyclic residue which may be condensed or or aryl group which contains 6 to 12 carbon atoms and may be substituted with a sulfo group (or the salt thereof), a carboxyl group (or the salt thereof), an alkyl group having 1 to 4 carbon atoms, an alkoxy group having 1 to 4 carbon atoms or a halogen atom; or R and R' in combination form a heterocyclic ring which may contain an —O— group);

$R_2$, $R_3$, $R_4$ and $R_5$ each is a hydrogen atom or an alkyl group which contains 1 to 4 carbon atoms and may be substituted with a hydroxyl group, etc.;

$Y_1$, $Y_2$, $Y_3$ and $Y_4$ each is a polymethylene group having 2 to 12 carbon atoms; a polymethylene group having 2 to 12 carbon atoms which is substituted with an alkyl group having 1 to 4 carbon atoms; an arylene group which may be substituted with a sulfo group (or the salt thereof), a carboxyl group (or the salt thereof), an alkyl group having 1 to 4 carbon atoms or a halogen atom; or a cycloalkyl group;

Z is —O—, —$SO_2$— or —$CH_2$—; and l and m each is 0 or an integer of 1.

The compounds according to the invention can be polymers which contain S-triazine rings. The compounds can be prepared according to the methods as described hereinbelow from the starting materials as described hereinbelow. There are no particular limitations on the distribution of the degree of polymerization for the compounds. According to the results of viscosity determination of their solutions and terminal group analysis thereof, the compounds are mostly polymers containing 4 or more s-triazine groups in the main chains thereof.

The compounds according to the invention can be prepared by:

(i) polycondensation between a s-triazine compound having the following General Formula (II):

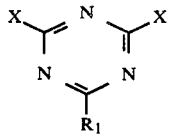

(II)

(wherein X represents a halogen atom, such as chlorine and bromine; and $R_1$; is as defined above) and a diamino compound having the following General Formula (III) or (IV):

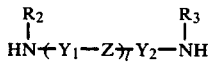

(III)

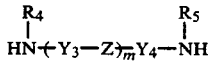

(IV)

(wherein $R_2$, $R_3$, $R_4$, $R_5$, $Y_1$, $Y_2$, $Y_3$, $Y_4$, Z, l and m are as defined above); or (ii) polycondensation between a diamino compound having the above-described General Formula (III) or (IV) and a bis-(halogeno-s-triazine) compound having the following General Formula (V) or (VI):

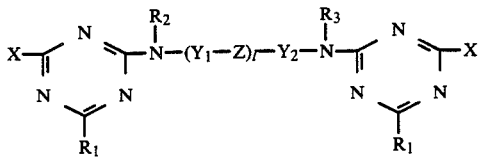

(V)

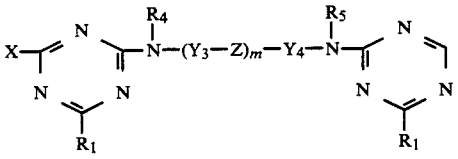

(VI)

(wherein X, $R_1$, $R_2$, $R_3$, $R_4$, $Y_1$, $Y_2$, $Y_3$, $Y_4$, Z, l and m are as defined above).

The halogeno-s-triazine compounds shown by General formula (II), (V) or (VI) described above can be prepared from cyanuric chlorides in accordance with methods described, e.g., in Journal of the American Chemical Society, Vol. 73, pp. 2981–2982 (1951).

As examples of $R_1$ which may be contained in the compounds shown by General Formula (I) described above, as well as in starting materials therefor shown by General Formulae (II), (V) and (VI) described above, mention may be made of the followings:

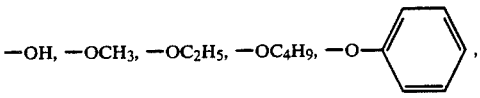

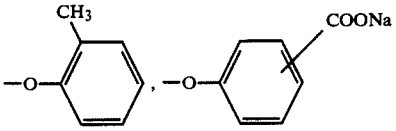

(O—,m-, p-),

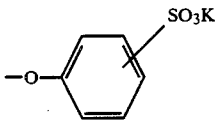

(O—, m-, p-),

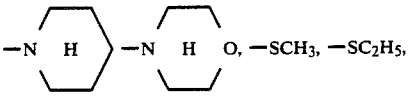

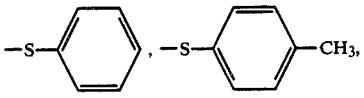

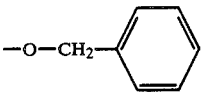

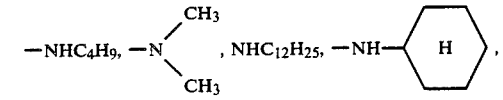

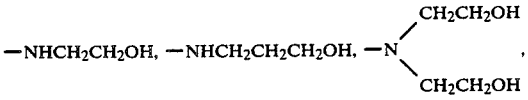

-continued

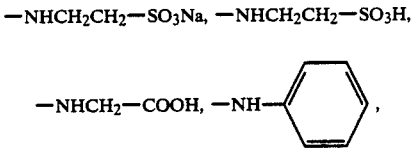

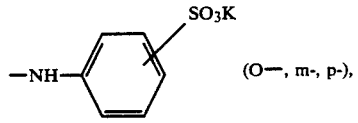

(O—, m-, p-),

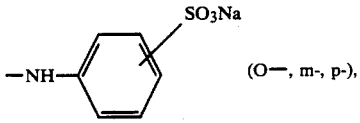

(O—, m-, p-),

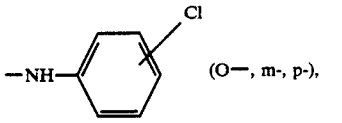

(O—, m-, p-),

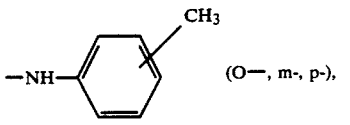

(O—, m-, p-),

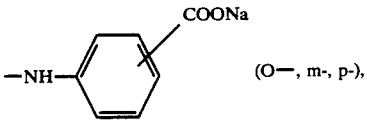

(O—, m-, p-),

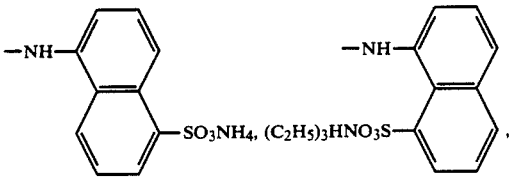

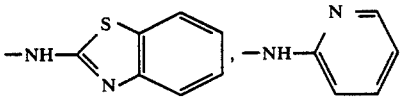

As examples of partial structure:

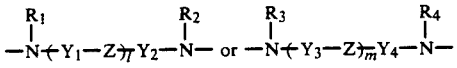

which may be contained in the compounds represented by General Formula (I), as well as in starting materials therefor shown by General Formula (III), (IV), (V) or (VI), mention may be made of the followings:

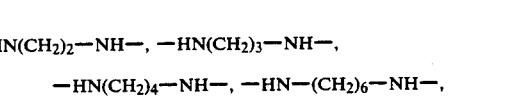

-continued $-HN(CH_2)_{12}-NH-$, $-HNCH_2CH_2-O-CH_2CH_2NH-$, $-HN-CH_2-CH(OH)-CH_2-NH-$, $-HN-C(CH_3)_2-CH_2-NH-$, $-HN-CH_2-C(CH_3)_2-CH_2NH-$, $-HN-CH_2-CH_2-C(CH_3)_2-CH_2CH_2NH-$, $-HN-(CH_2)_3-N(CH_2CH_2OH)-$ $-N(CH_3)-(CH_2)_2-N(CH_3)-$, $-N(CH_3)-(CH_2)_3-N(CH_3)-$, 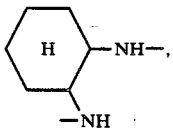

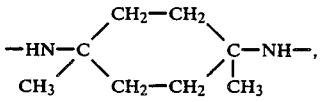

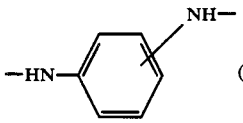

(O—, m-, p-),

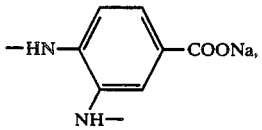

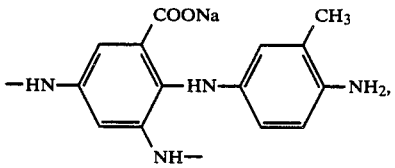

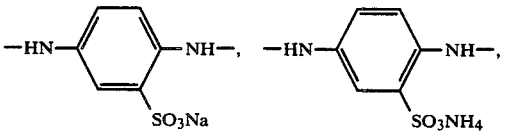

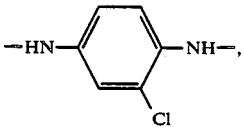

-continued

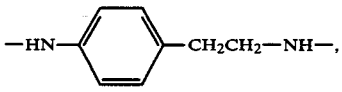

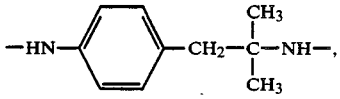

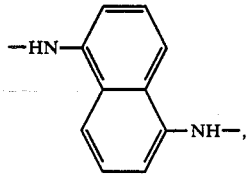

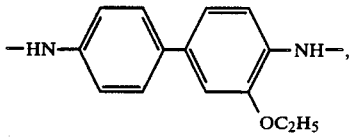

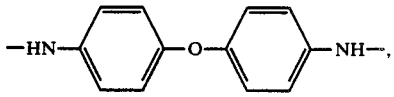

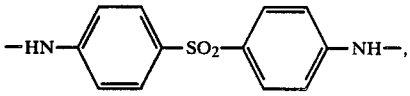

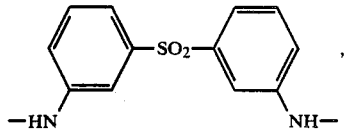

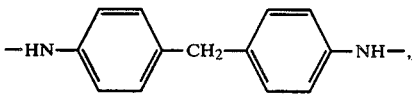

Preparation of the compounds according to the invention which contain the recurring unit represented by General Formula (I) can be carried out in accordance with either of the following general methods:

(a) In a suitable solvent (preferably water, acetone, dioxiane, dimethylformamide, diethylformamide, etc.), 1 mole of a dihalogenated-s-triazine compound shown by General Formula (II) is reacted with ca. 1 mole of a diamino compound shown by General Formula (III) or (IV) at a suitable temperature (preferably between 10° to 150° C.) in the presence or absence of a deacidifier (preferably inorganic bases, such as acidic alkali carbonates, alkali carbonates and caustic alkalis, or organic bases, such as pyridine, 2,4,6-trimethylpyridine and diaminobicyclooctane); or (b) In a solvent as described in (a) above, 1 mole of a bis(halogeno-s-triazine) compound shown by General Formula (V) or (VI) is reacted with ca. 1 mole of a diamino compound shown by General Formula (III) or (IV) at a suitable temperature (preferably between 30° and 150° C.) in the presence or absence of the same acidifier as those described in (a) above.

In the practice of the present invention, however, there can as well be used compounds prepared by methods other than the above general methods.

Examples of compounds containing the recurring units represented by General Formula (I) and to be used in the present invention include those shown below. In the formulae set forth below, n indicates the number of s-triazine rings contained in each compound.

Compound 1 $n \geqq 4$

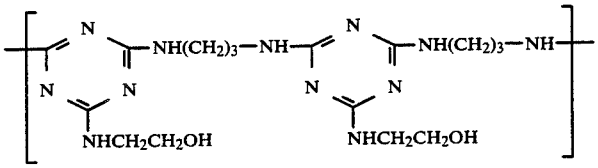

(n hereinafter represents the number of an S—triazine ring present in a molecular)

Compound 2 $n \geqq 4$

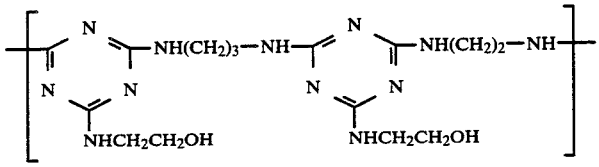

Compound 3 $n \geqq 4$

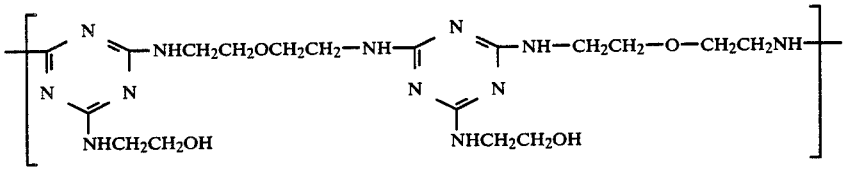

Compound 4 $n \geqq 4$

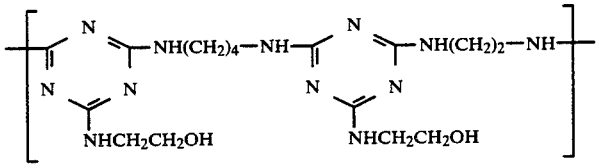

Compound 5 $n \geqq 4$

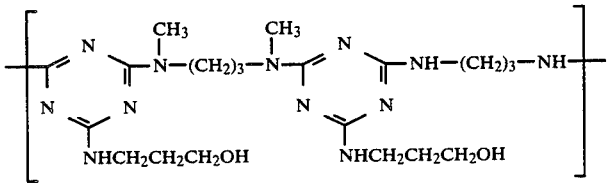

Compound 6 $n \geqq 4$

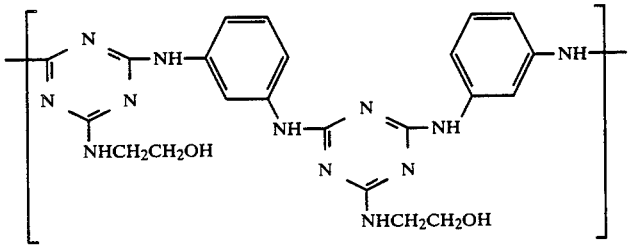

Compound 7 $n \geqq 4$

-continued
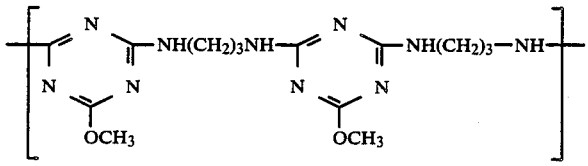
Compound 8 n ≧ 4
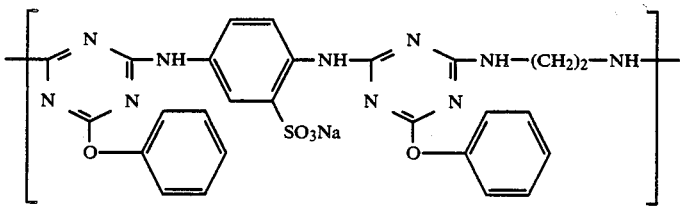
Compound 9 n ≧ 4
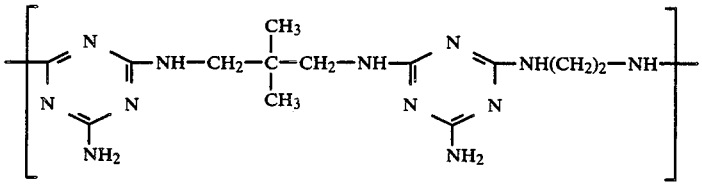
Compound 10 n ≧ 4
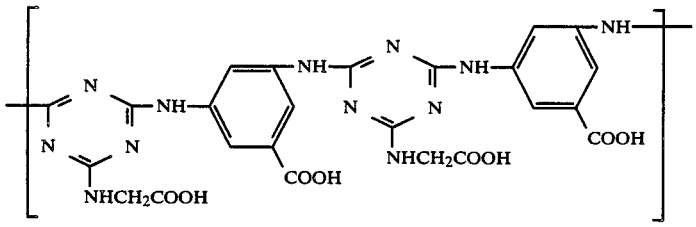
Compound 11 n ≧ 4
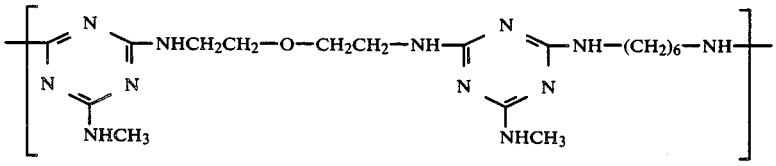
Compound 12 n ≧ 4
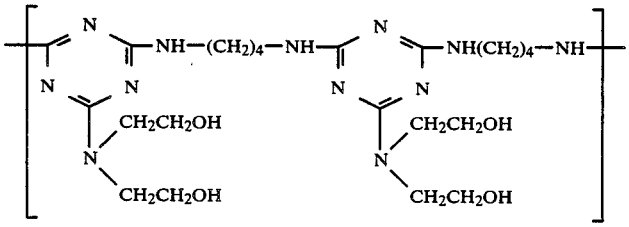
Compound 13 n ≧ 4
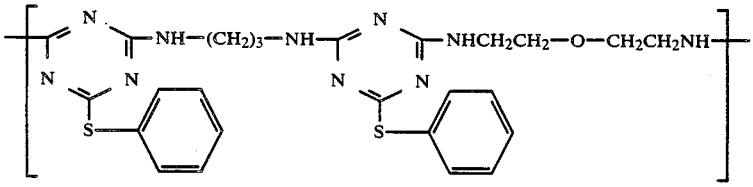
Compound 14 n ≧ 4

-continued
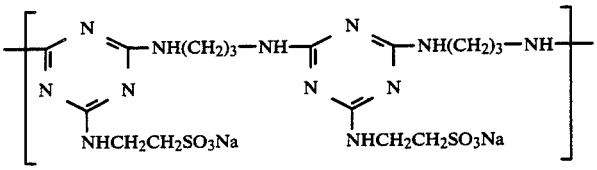
Compound 15 n ≧ 4
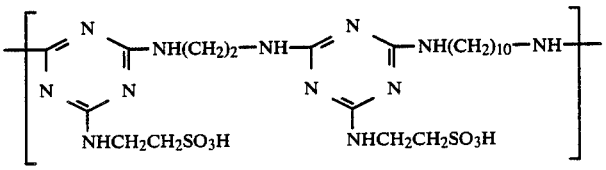
Compound 16 n ≧ 4
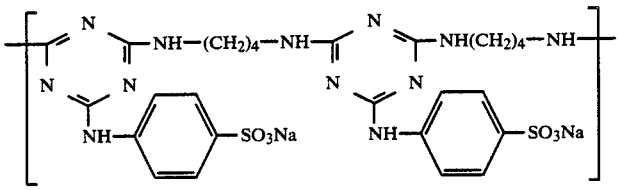
Compound 17 n ≧ 4
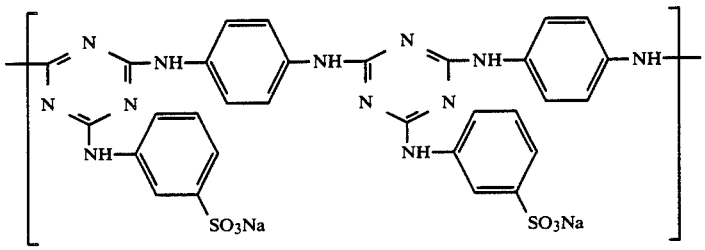
Compound 18 n ≧ 4
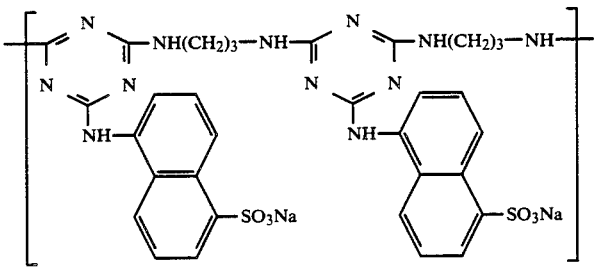
Compound 19 n ≧ 4
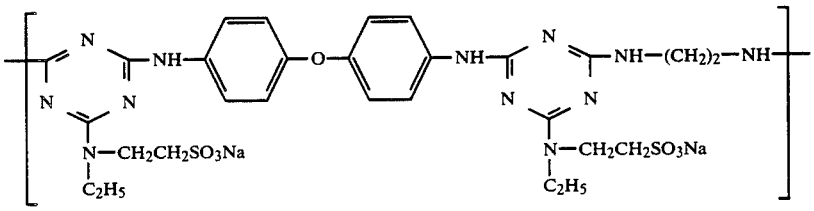
Compound 20 n ≧ 4

-continued
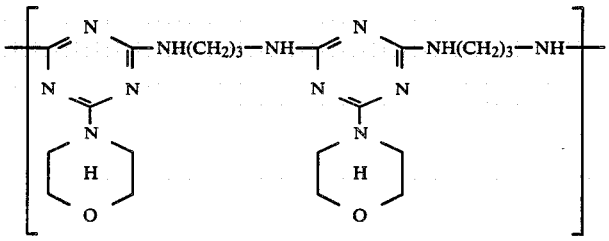
Compound 21 n ≧ 4
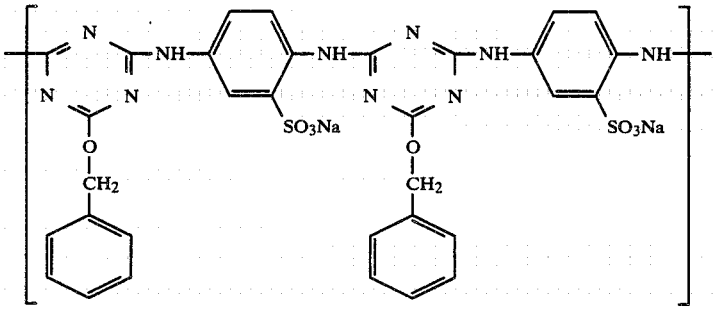
Compound 22 n ≧ 4
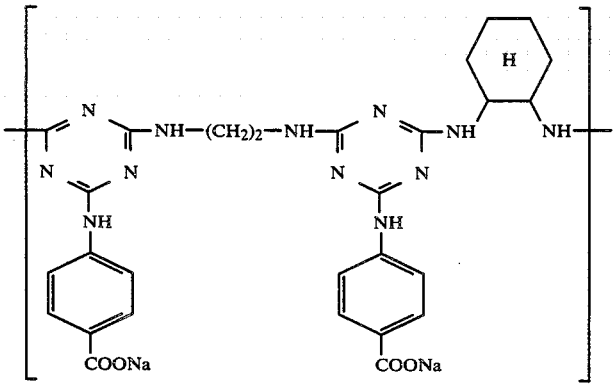
Compound 23 n ≧ 4
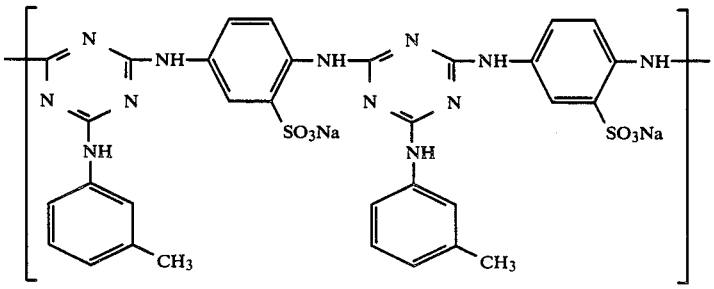
Compound 24 n ≧ 4

-continued
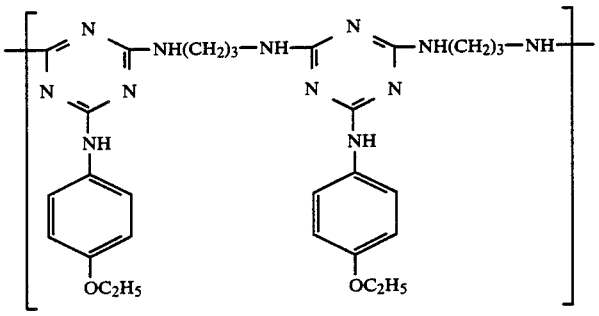
Compound 25 n ≧ 4
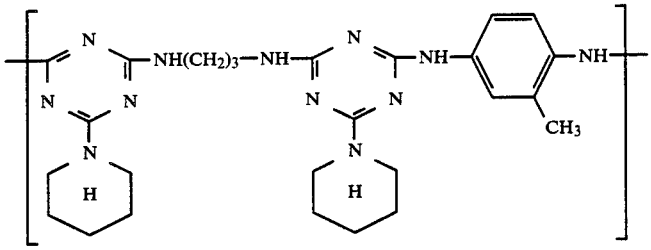
Compound 26 n ≧ 4
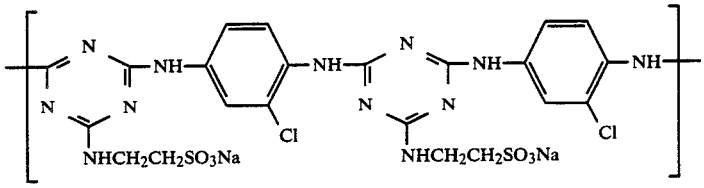
Compound 27 n ≧ 4
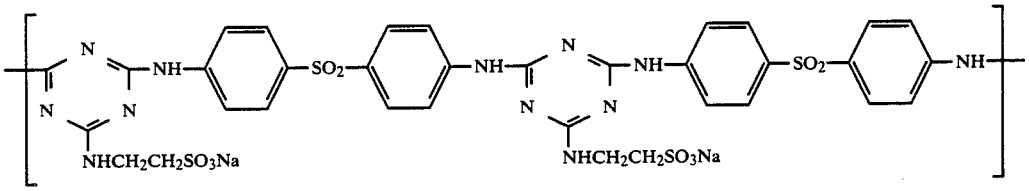
Compound 28 n ≧ 4
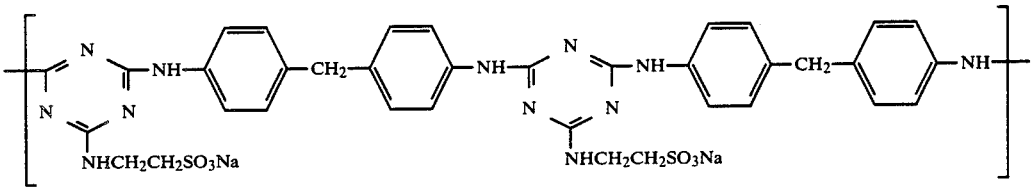
Compound 29 n ≧ 4
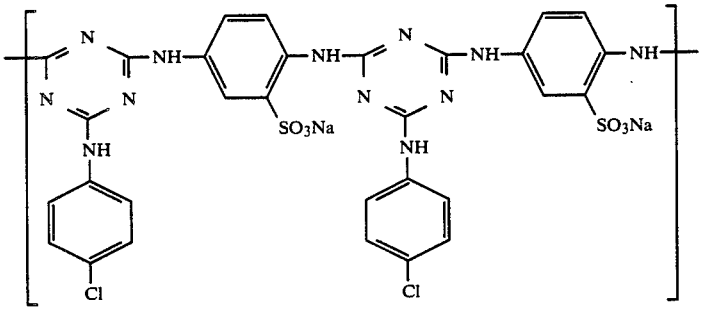

-continued

Compound 30

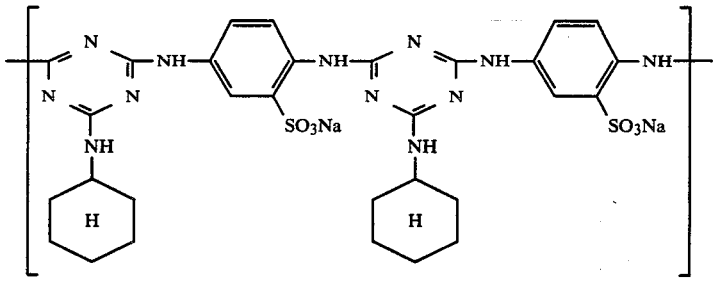

Compound 31

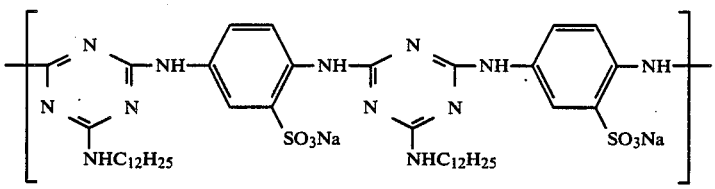

As described hereinabove, the compounds containing the recurring units represented by General Formula (I) prevent changes in the sensitivity and maximum density of color reversal light-sensitive materials, due to the variation in the concentration of potassium bromide contained in the first developer for color reversal processing. The compounds show no adverse effects on other photographic properties. The compounds can be used individually, or combinations of the compounds can also be used. In addition, the compounds can be used in combination with other additives, such as antifogging agents.

The color reversal light-sensitive material of the present invention comprises at least a pair of silver halide emulsion layers having mutually different color sensitivities and silver/coupler ratios different by a factor of at least 5, and the compounds containing the recurring units represented by General Formula (I) is incorporated into the emulsion layer(s) having the smaller (or smallest) silver/coupler ratio(s). The incorporation of the compounds can be carried out at any stage before coating the emulsions. It is however preferable to effect the incorporation at a stage between chemical ripening and the coating. Since the compounds are soluble in water, dimethylformamide, dimethylsulfoxide and aqueous solutions of acids (e.g., inorganic acids, such as hydrochloric, sulfuric and nitric acids, and organic acids, such as acetic acid) or alkalis (e.g., acidic alkali carbonates, alkali carbonates, caustic alkalis, etc.), a solution of the compounds in one or more of these solvents can be preferably utilized for said incorporation.

There are no particular limitations on the amount of the compounds to be used. It is, however, preferable to use the compounds in an amount of from 0.01 to 50 g, more preferably from 0.1 to 40 g, most preferably from 0.1 to 5 g, per mole of silver halide contained in the silver halide emulsion layer into which the compounds are incorporated.

The present invention can be applied with particular advantage to light-sensitive materials comprising at least a pair of emulsion layers having silver/coupler ratios which are different by a factor of at least 10.

As examples of pairs of silver halide emulsions having different color sensitivities which may be contained in the light-sensitive materials of the present invention, mention may be made of pairs consisting of a blue-sensitive emulsion layer and a green-sensitive emulsion layer; pairs consisting of a green-sensitive emulsion layer and a red-sensitive emulsion layer; and pairs consisting of a blue-sensitive emulsion layer and a red-sensitive emulsion layer. In preferable embodiments of the invention, the light-sensitive materials comprise a support having coated thereon a red-sensitive emulsion layer, a green-sensitive emulsion layer and a blue-sensitive emulsion layer. In such embodiments, at least one of the three possible pairs of said emulsion layers must have silver/coupler ratios which are different by a factor of at least 5, more preferably at least 10. In cases where two of the three pairs of said emulsion layers satisfy the requirement on the difference in silver/coupler ratio according to the invention, the compounds can be incorporated into the one emulsion layer having the smaller silver/coupler ratio in one of the pairs. It is, however, more preferable to incorporate the compounds into the two emulsion layers having the smaller silver/coupler ratios in each of the pairs of silver halide emulsion layers.

In the red-, green- and blue-sensitive emulsion layers to be comprised in the light-sensitive materials according to the present invention, there can be used any silver halides which are capable of forming latent images through image-wise exposure. Examples of usable silver halide include silver bromide, silver iodobromide, silver iodochlorobromide and silver chloroiodide.

In the light-sensitive material of the invention, the average grain size of silver halide grains contained in silver halide emulsion layers is of no critical meaning. However, it is preferable to use silver halide grains having an average grain size of not more than 3μ. (Average grain size herein means an average of diameter of grains with respect to spherical or semi-spherical grains, and the length of edges with respect to cubic grains; presented in terms of an average based on projected area.) The grains may have any kind of distributions, including both narrow and broad distributions.

Silver halide grains used in photographic emulsion layers in the light-sensitive material of the invention can be either of regular form, such as cubic and octahedral, or of irregular form, such as spherical and tabular. The grains can have composite crystal forms, as well. It is also possible to use a mixture of grains having different crystal forms.

Photographic emulsions used in the present invention can be prepared in accordance with methods described, e.g., by P. G. Glafkides, "Chemie et Physique Photographique", published by Paul Montel (1967), G. F. Duffin, "Photographic Emulsion Chemistry", published by The Focal Press (1966), V. L. Zelikman et al., "Making and Coating Photographic Emulsion", published by The Focal Press (1964), etc., including acid methods, neutral methods and ammonia methods. The reaction between a soluble silver salt and a soluble halide can be conducted by a single jet method or a double jet method, as well as by a combination of these methods. It is also possible to employ the so-called reversal mixing method, wherein silver halide grains are formed in the presence of an excess of silver ions. As a modification of the double jet method, there may also be employed the so-called controlled double jet method, wherein the formation of silver halide grains is conducted while maintaining the pAg in the liquid phase at a constant level. Silver halide emulsions having regular crystal forms and almost uniform grain sizes can be obtained by this method. There can also be used mixtures of two or more of silver halide emulsions prepared separately.

The formation of silver halide grains or the physical ripening step thereof can be carried out in the presence of cadmium salts, zinc salts, lead salts, thallium salts, salts or complexes of irridum, salts or complexes of rhodium, salts or complexes of iron, etc.

Usually, the silver halide emulsions are chemically sensitized although it is also possible to use emulsions not subjected to chemical sensitization, in other words, so-called primitive emulsions. For the chemical sensitization of the silver halide emulsions, there can be employed various methods, including those described in the aforementioned books written by Glafkides and Zelikman, as well as those described in "Die Grundlagen der Photographischen Prozesse mit Silverhalogeniden", edited by H. Frieser (Alademische Verlagsgesellschaft, 1968). Useful chemical sensitization methods include sulfur sensitization in which sulfur-containing compounds or active gelatins are used, reduction sensitization in which reducing substances are used, and noble metal sensitization in which compounds of noble metals, such as gold, are used. These sensitization techniques can be used either separately or in combination. Examples of usable sulfur sensitizers include thiosulfates, thioureas, thiazoles, rhodanines, etc. Specific examples of such compounds are described, e.g., in U.S. Pat. Nos. 1,574,944, 2,410,689, 2,278,947, 2,728,668 and 3,656,955. Examples of usable reduction sensitizers include stannous salts, amines, hydrazine derivatives, formamidinesulfinic acids, silane compounds, etc. Specific examples of reduction sensitizers are described, e.g., in U.S. Pat. Nos. 2,487,850, 2,419,974, 2,518,698, 2,983,609, 2,983,610 and 2,694,637. For the noble metal sensitization, there can be used complexes of gold and group VIII metals, such as platinum, iridium and paradium. Specific examples of such sensitizers are described, e.g., in U.S. Pat Nos. 2,399,083 and 2,448,060; British Pat. No. 618,061; etc.

Each of the photographic light-sensitive emulsion layers in the light-sensitive materials of the invention is incorporated with a color-forming coupler, namely, a compound capable of forming color through oxidative coupling with an aromatic primary amine developer (e.g., phenylenediamine derivatives, aminophenol derivatives, etc.) during the course of color development processing. For example, in green-sensitive emulsion layers are used magenta couplers, such as 5-pyrazolone couplers, pyrazolobenzimidazole couplers, cyanoacetylcoumarone couplers, open chain acylacetonitrile couplers, etc.; in blue-sensitive emulsion layers are used yellow couplers, such as acylacetamide couplers (e.g., benzoylacetanilides and pyvaloylacetanilides) or the like; and in red-sensitive emulsion layers are used cyan couplers, such as naphthol and phenol couplers. Non-diffusion couplers containing a hydrophobic group (so-called ballast group) within the molecule are preferable. These couplers can be either 2- or 4-equivalent.

Specific examples of usable magneta color-forming couplers include those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445; West German Pat. No. 1,810,464; West German Patent Application (OLS) Nos. 2,408,665, 2,417,945, 2,418,959 and 2,414,467; Japanese Patent Publication No. 6031/65; and Japanese Patent Application (OPI) Nos. 20826/76, 13041/75, 58922/77, 129538/74, 74027/74, 159336/75, 42121/77, 74028/74, 60233/75, 26541/76 and 55122/78.

Specific examples of usable yellow-color forming couplers include those described in U.S. Pat. Nos. 2,875,057, 3,265,506, 3,408,194, 3,551,155, 3,582,322, 3,725,072 and 3,891,445; West German Pat. No. 1,547,868; West German Patent Application (OLS) Nos. 2,219,917, 2,261,361 and 2,414,066; British Pat. Nos. 1,425,020; Japanese Patent Publication No. 10783/76; and Japanese Patent Application (OPI) Nos. 26133/72, 73147/73, 102636/76, 6341/75, 123342/75, 130442/75, 21827/76, 87650/75, 82424/77 and 115219/77.

Specific examples of usable cyan couplers include those described in U.S. Pat. Nos. 2,369,929, 2,434,272,2,474,293, 2,521,908, 2,895,826, 3,034,892, 3,311,476, 3,458,315, 3,476,563, 3,583,971, 3,591,383, 3,767,411 and 4,044,929; West German Patent Application (OLS) Nos. 2,414,380 and 2,454,329; and Japanese Patent Application (OPI) Nos. 59838/73, 36034/76, 5055/73, 146828/76, 60624/77 and 90932/77.

The photographic emulsions to be used in the photographic light-sensitive materials of the present invention can be spectrally sensitized by sensitizing dyes. Examples of usable sensitizing dyes include cyanines, merocycanines, complex cyanines, complex merocyanines, holopolar cyanines, hemicyanines, styryls and hemioxonols. Dyes belonging to cyanine, merocyanine and complex cyanine series can be particularly preferable. In these cyanine dyes there can be contained any basic heterocyclic nucleus utilized in ordinary cyanine dyes, including, for example, such nuclei as pyrolines, oxazolines, thiazolines, pyrroles, oxazoles, thiazoles, selenazoles, imidazoles, tetrazoles, and pyridines; those nuclei formed by the fusion of one of these nuclei with an alicyclic hydrocarbon ring; and nuclei formed by fusing one of these nuclei with an aromatic hydrocarbon ring, such as indolenines, benzindolenines, indoles, benzoxazoles, naphthoxazoles, benzothiazoles, naphthothiazoles, benzoselenazoles, benzimidazoles and quinonlines. These nuclei can contain substituents on ring carbon atoms thereof. In mercyanine and complex cyanine dyes there can be contained nuclei having a ketomethylene structure, including, for example, 5- or 6-membered heterocyclic neclei, such as pyrazolin-5-ones, thiohydantoins, 2-thiooxazolidine-2,4-dinones, thiazolidin-2,4-diones, rhodanines and thiobarbitals.

Of these sensitizing dyes, those having at least two water-soluble groups can be particularly useful. Such dyes are described in Japanese Patent Application No. 10091/83 filed on Jan. 25, 1983 by the present applicant.

In the above Japanese Patent Application, it is disclosed that at least one of the green-sensitizing dye and the red-sensitizing dye used there has at least two water-solubilizing groups. The water-solubilizing group means preferably carboxyl group and sulfo group.

Such sensitizing dyes having at least two water-solubilizing groups are known, which have been described in, for examples, U.S. Pat. Nos. 3,655,394, 3,656,956, 3,672,897, 3,694,217 and 3,667,960 and Japanese Patent Publication No. 14030/69, etc.

The sensitizing dyes used in the above Japanese Patent Application are dissolved in water or water-soluble organic solvents such as methanol, ethanol, acetone, methyl cellosolve or pyridine, etc., and added to the silver halide emulsion, as a mixture or respectively. In order to dissolve the sensitizing dyes, stirring by ultrasonic wave can be adopted. The amount to be added, the order of addition and the step for adding can be suitably changed according to the purpose. It is preferred that the amount of the sensitizing dyes used is generally in a range of $1\times10^{-6}$ mol to $5\times10^{-4}$ mol per mol of silver halide.

The effect described in the above Japanese Patent Application is remarkably shown when red-sensitizing dyes represented by the following general formula (VII) are used.

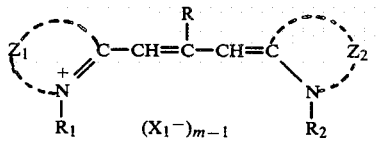

(VII)

In the formula, R represents a lower alkyl group (for example, a methyl group or an ethyl group, etc.), a phenyl group or a hydrogen atom, $R_1$ and $R_2$ each represents an alkyl group (for example, a methyl group, an ethyl group or a propyl group, etc.) or an alkyl or alkoxyalkyl group having at least one of sulfo group and carboxyl group (for example, a carboxymethyl group, a 3-carboxypropyl group, a 4-carboxybutyl group, a 3-sulfopropyl group, a 1-sulfobutyl group, a 3-sulfobutyl group, a 2-(3-sulfopropoxy)ethyl group or a 2-hydroxy-3-sulfopropyl group, etc.), and at least one of $R_1$ and $R_2$ represents an alkyl group having at least one of sulfo group and carboxyl group.

$Z_1$ represents an atomic group necessary to form a naphthothiazole nucleus (for example, a naphtho[1,2-d]thiazole nucleus, a naphtho[2,1-d]thiazole nucleus or a naphtho[2,3-d]thiazole nucleus), a benzothiazole nucleus (for example, a 5-chlorobenzothiazole nucleus, a 5-methylbenzothiazol nucleus, a 5,6-dichlorobenzothiazole nucleus, a 5,6-dimethylbenzothiazole nucleus, a 5-phenylbenzothiazole nucleus or a 5-methoxybenzothiazole nucleus), a benzoselenazole nucleus (for example, a 5-chlorobenzoselenazole nucleus, a 5-methylbenzoselenazole nucleus, a 5,6-dimethylbenzoselenazole nucleus, a 5,6-dichlorobenzoselenazole nucleus, a 5-phenylbenzoselenazole nucleus or a 5-methoxybenzoselenazole nucleus) or a naphthoselenazole nucleus (for example, a naphtho[1,2-d]selenazole nucleus, a naphtho[1,2-d]selenazole nucleus or a naphtho[2,3-d]selenazole nucleus), and $Z_2$ represents an atomic group necessary to form a naphthothiazole nucleus (for example, a naphtho[1,2-d]thiazole nucleus, a naphtho[2,1-d]thiazole nucleus, or a naphtho[2,3-d]thiazole nucleus), a benzothiazole nucleus (for example, a 5-chlorobenzothiazole nucleus, a 5-methylbenzothiazole nucleus, a 5,6-dichlorobenzothiazole nucleus, a 5,6-dimethylbenzothiazole nucleus, a 5-phenylbenzothiazole nucleus or a 5-methoxybenzothiazolenucleus), a naphthoselenazole nucleus (for example, a naphtho[1,2-d]selenazole nucleus, a naphtho[2,1-d]selenazole nucleus or a naphtho[2,3-d]selenazole nucleus), a benzoselenazole nucleus (for example, a 5-chlorobenzoselenazole nucleus, a 5-methylbenzoselenazole nucleus, a 5,6-dichlorobenzoselenazole nucleus, a 5,6-dimethylbenzoselenazole nucleus, a 5-phenylbenzoselenazole nucleus or a 5-methoxybenzoselenazole nucleus), a benzimidazole nucleus (for example, a 5-chloro-1-ethylbenzimidazole nucleus, a 5-methyl-1-ethylbenzimidazole nucleus, a 5,6-dichloro-1-ethylbenzimidazole nucleus, a 5,6-dimethyl-1-ethylbenzimidazole nucleus, an N-ethyl-5-phenylbenzimidazole nucleus or an N-ethyl-5-methoxybenzimidazole nucleus), a benzoxazole nucleus (for example, a 5-chlorobenzoxazole nucleus, a 5-methylbenzoxazole nucleus, a 5,6-dichlorobenzoxazole nucleus, a 5,6-dimethylbenzoxazole nucleus, a 5-phenylbenzpxazole nucleus or a 5-methoxybenzoxazole nucleus) or a naphthoxazole nucleus (for example, a naphtho[1,2-d]oxazole nucleus, a naphtho[2,1-d]oxazole nucleus or a naphtho[2,3-d]oxazole nucleus). When only one alkyl group having a carboxyl group or sulfo group is contained in $R_1$ or $R_2$, $Z_1$ and $Z_2$ contain at least one alkyl group having a sulfo group or carboxyl group. $X_1^-$ represents an acid anion, and m is 1 or 2. The above described sulfo group and carboxyl group may be free or may form a salt. Further, they may have a substituent which is cleft under an alkaline condition (for example, an aminoalkyl group).

Examples of the red-sensitizing dyes represented by general formula (VII) are shown below.

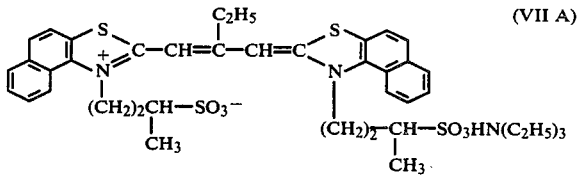

(VII A)

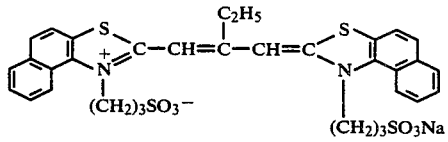

(VII B)

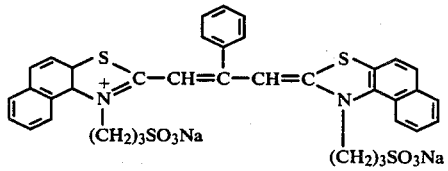

(VII C)

-continued (VII D)

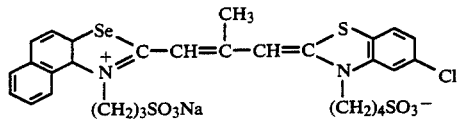

(VII E)

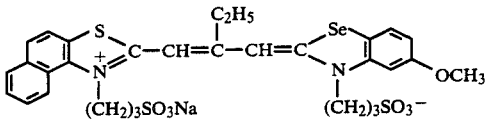

(VII F)

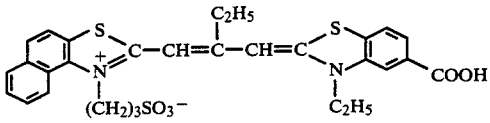

(VII G)

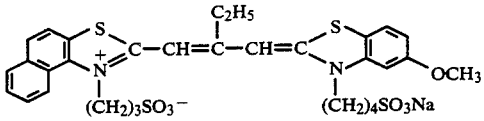

(VII H)

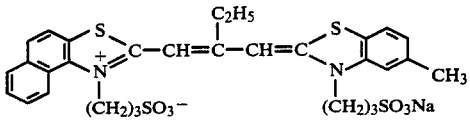

(VII I)

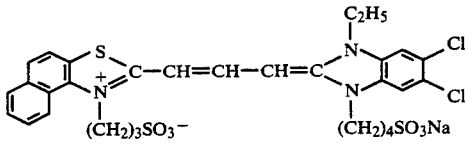

(VII J)

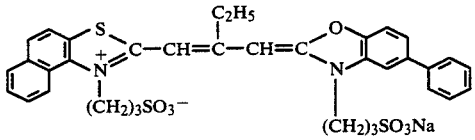

(VII K)

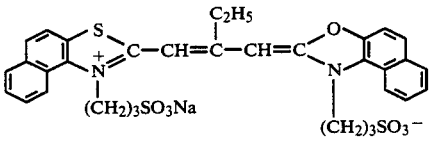

(VII L)

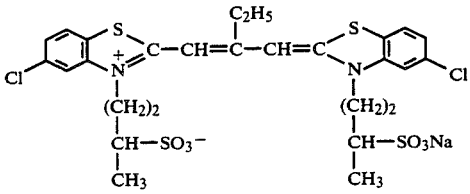

(VII M)

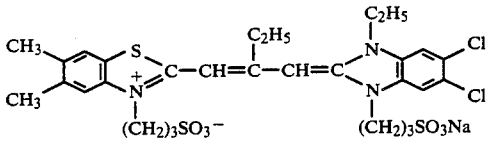

(VII N)

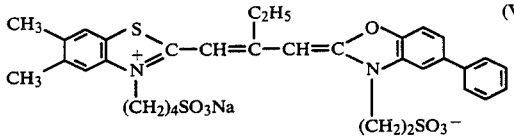

-continued (VII O)

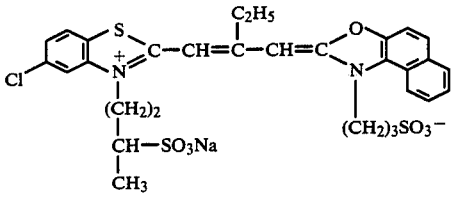

The sensitizing dyes can be used either individually or in combination. Combinations of sensitizing dyes are often used for the purpose of supersensitization. Typical examples of supersensitizing dyes are described, e.g., U.S. Pat. Nos. 2,688,545, 2,977,229, 3,397,060, 3,522,052, 3,527,641, 3,617,297, 3,628,964, 3,666,480, 3,672,989, 3,679,428, 3,703,377, 3,769,301, 3,814,609, 3,837,862 and 4,026,707; British Pat Nos. 1,344,281 and 1,507,803; Japanese Patent Publication Nos. 4936/68 and 12375/78; and Japanese Patent Application (OPI) Nos. 110618/77 and 109925/77.

The sensitizing dyes can also be used in combination with other dyes which per se have no sensitizing effects and colorless substance which do not absorb visible light, in order to attain super sensitizing effects.

Each of the light-sensitive emulsion layers contained in the light-sensitive material of the present invention can consist of more than one separate layer. In such a case, each light-sensitive emulsion layer consists of a plurality of emulsion layers having the same color sensitivity and having different photographic speeds (or sensitivities), a layer having higher speed being positioned over a layer having slower speed. The comparison of silver/coupler ratios of such emulsion layers is to be made between layers having photographic speeds (or sensitivities) of the same or similar level, for example, between a slow speed blue-sensitive emulsion layer and a slow green-sensitive emulsion layer.

The present invention can be particularly effective in order to be eliminated the defects occurring in cases where there exist said differences in silver/coupler ratios between slow speed (or low sensitive) emulsion layers.

The present invention can be suitably applied to a color reversal light-sensitive material comprising an interlayer containing silver halide grains having been previously fogged on the surface thereof and positioned between a red-sensitive emulsion layer and a green-sensitive emulsion layer. The prefogging treatment of the silver halide grains can be made either with chemicals or by exposure to light. Detailed procedures for preparing fogged grains are described, e.g., in "The Theory of the Photographic Process", 4th Ed., p. 185, edited by T. H. James (1977); and U.S. Pat. Nos. 2,717,833, 3,367,778, 3,501,305, 3,501,306 and 3,501,307. The fogging treatment of the silver halide grains can be effected through the addition of a reducing agent or a gold salt under appropriate pH and pAg conditions, as well as through heating the emulsion under low pAg condition or uniform exposure to light. In this treatment, there can be used such reducing agents as stannous chloride, hydrazines, ethanolamines and thiourea dioxide. Fogged silver halide grains which can be used therefor include grains of silver chloride, silver bromide, silver chlorobromide, silver iodobromide, silver chloroiodide an silver chloroiodobromide.

The fogged silver halide grains are preferably fine grains having an average grain size of from 0.01 to 0.5μ, more preferably from 0.01 to 0.4μ.

The fogged silver halide can be either regular or irregular grains. The effects of the invention can be attained more effectively in cases where regular grains (e.g., octahedral or hexahedral grains) are employed. The grains can be either mono- or polydisperse. It can however be advantageous to use monodisperse grains. Particularly good results can be attained in cases where the fogged silver halide grains have a coefficient of variation of size distribution not greater than 20%.

The fogged silver halide grains are preferably used in interlayers at a coverage of silver of from 5 to 500 $mg/m^2$, in particular, from 10 to 400 $mg/m^2$. Interlayers containing such small amounts of fogged silver halide grains are not able to function as a barrier for light, as in the case described in U.S. Pat. No. 2,319,369. However, the interlayers sufficiently fulfil the objectives of the present invention.

The fogged silver halide grains may be uniformly distributed in interlayers, or the grains may be present more densely in the upper areas of the interlayers than in the lower areas of the interlayers. In the case where each light-sensitive emulsion layer consists of a slow speed (or low sensitive) layer and a high speed (or high sensitive) layer, the latter being positioned over the former and having an identical color sensitivity with the former, even slight fogs which may be generated in the red-sensitive emulsion layer can be prevented by providing a lower interlayer not containing fogged silver halide grains and an upper interlayer containing fogged silver halide grains between the high speed red-sensitive emulsion layer and the slow speed green-sensitive emulsion layer, said lower interlayer being positioned over said high speed red-sensitive emulsion layer.

Gelatin can be used with advantage as a binding agent in the photographic light-sensitive emulsion layers, interlayers and other photographic layers contained in the photographic light-sensitive materials of the invention. However, it is also possible to use other hydrophilic colloids, including, e.g., proteins, such as gelatin derivatives, graft polymers between gelatin and other polymers, albumin and casein; saccharose derivatives, such as hydroxyethylcelluloses, carboxymethylcelluloses and cellulose sulfates; starch derivatives, such as sodium alginate; and synthetic hydrophilic polymers, such as polyvinyl alcohols, partial acetals of polyvinyl alcohols, poly-N-vinylpyrrolidones, polyacrylates, polymethacrylates, polyacrylamides, polyvinylimidazoles, polyvinylpyrazoles and copolymers of thereof. Examples of usable gelatins include lime-processed gelatins, acid-processed gelatins, enzyme-processed gelatins, such as those described in Bull. Soc. Sci. Phot. Japan, Vol. 16, 30 (1966), and hydrolysed or enzyme-decomposed gelatins. Gelatin derivatives usable in the practice of the invention can be produced by reacting gelatin with acid halides, acid anhydrides, isocyanates, bromoacetates, alkanesultones, vinylsulfonamides, maleinimide compounds, polyalkylene oxides and epoxy compounds. Specific examples of such compounds are described, e.g., in U.S. Pat. Nos. 2,614,928, 3,132,945, 3,186,846 and 3,312,553; British Pat. Nos. 861,414, 1,033,189 and 1,005,784; and Japanese Patent Publication No. 26845/67.

Examples of usable graft polymers mentioned above include gelatins grafted with homo- or copolymers of vinyl monomers, such as acrylic acid, methacrylic acid and the derivatives such as esters or amides thereof, acrylnitrile and styrene. Graft polymers between gelatin and a polymer which is more or less compatible with gelatin (e.g., polymers of acrylic acid, methacrylic acid, acrylamide, methacrylamide, hydroxyalkyl methacrylates, etc.) can be particularly preferable. Specific examples of such graft polymers are described, e.g., in U.S. Pat. Nos. 2,763,625, 2,831,767 and 2,956,884.

Typical examples of synthetic hydrophilic polymers which can be used in the practice of the present invention include those described, e.g., in published German Patent Application (OLS) No. 2,312,708; U.S. Pat. Nos. 3,620,751 and 3,879,205; and Japanese Patent Publication No. 7561/68.

In order to increase contrast and sensitivity, as well as to accelerate development, the light-sensitive materials of the invention can be incorporated with such additives as polyoxyalkylene oxides or the derivatives such as ethers, esters or amides thereof, thioethers, thiomorpholines, quaternary ammoniums, urethane derivatives, urea derivatives, imidazole derivatives and 3-pyrazolidones. Specific examples of such additives are described, for example, in U.S. Pat. Nos. 2,400,532, 2,423,549, 2,716,062, 3,617,280, 3,772,021 and 3,808,003.

The light-sensitive material of the invention can be additionally incorporated with various compounds as an antifoggant or stabilizer. Examples of known antifoggants and stabilizers usable in the invention include azoles, such as benzothiazoliums, nitroindazoles, triazoles, benzotriazoles and benzimidazoles (in particular, nitro- or halogen-substituted derivatives thereof); heterocyclic mercapto compounds, such as mercaptothiazoles, mercaptobenzothiazoles, mercaptobenzimidazoles, mercaptothiadiazoles, mercaptotetrazoles (in particular, 1-phenyl-5-mercaptotetrazole) and mercaptopyridines; heterocyclic mercapto compounds containing water soluble groups, such as carboxyl and sulfo groups; thioketo compounds, such as oxazolinethiones; azaindenes, such as tetrazaindenes (in particular, 4-hydroxy-substituted (1,3,3a,7)-tetrazaindenes); benzenethiosulfonic acids; benzenethiosulfinic acids; and the like. As to more specific examples and ways to use these compounds, reference can be made, for example, to U.S. Pat. Nos. 3,954,474, 3,982,947 and 4,021,248; and Japanese Patent Publication No. 28660/77.

The light-sensitive materials of the invention can contain, in photographic emulsion layers and other layers thereof, inorganic or organic hardeners, including, e.g., chromates, such as chromium alum and chromium acetate; aldehydes, such as formaldehydes, glyoxal and glutaraldehyde; N-methylol compounds, such as dimethylolurea and methyloldimethylhydantoin; dioxane derivatives, such as 2,3-dihydroxydioxane; active vinyl compounds, such as 1,3,5-triacryloylhexahydro-s-triazine and 1,3-vinylsulfonyl-2-propanol; active halogeno compounds, such as 2,4-dichloro-6-hydroxy-s-triazine; mucohalogenoic acids, such as mucochloric acid and mucophenoxychloric acid; and the like. Combinations of these compounds can also be used.

The light-sensitive materials of the invention can contain, in the photographic emulsion layers and other hydrophilic layers thereof, various surface active agents, for a variety of purposes, e.g., to improve coating, antistatic, slippage, emulsifying and antiadhesion properties and to accelerate development, as well as to improve such photographic properties as gamma and sensitivity. Examples of usable surface active agents include natural surface active agents, such as steroids (e.g., saponin), nonionic surface active agents, such as alkylene oxide derivatives (e.g., polyethylene glycols, polyethylene glycol/polypropylene glycol condensation products, polyethylene glycol alkyl or alkylaryl ethers, polyethylene glycol esters, polyethylene glycol sorbitan esters, polyalkylene glycol alkylamines and alkylamides, and polyethylene oxide addition products of silicones), glycidol derivatives (e.g., polyglycerides of alkenylsuccinic acids and alkylphenol polyglycerides), fatty acid esters of polyhydric alcohols and alkylesters of saccharoses; anionic surface active agents containing acidic groups (e.g., carboxyl, sulfo, phospho, sulfate and phosphate groups), such as alkylcarboxylates, alkylsulfonates, alkylbenzenesulfonates, alkylnaphthalenesulfonates, alkylsulfonates, alkylphosphates, N-acyl-N-alkyltaurines, sulfosuccinates, sulfoalkylpolyoxyethylene alkylphenyl ethers and polyoxyethylene alkylphosphoric acid esters; amphoteric surface active agents, such as amino acids, aminoalkylsulfonic acids, aminoalkylsulfonic or aminoalkylphosphoric esters, alkylbetaines and amine oxides; and cationic surface active agents, such as alkylamines, aliphatic or aromatic quaternary ammoniums, heterocyclic quaternary ammonium salts (e.g., pyridiniums and imidazoliums), and phosphonium or sulfonium salts containing aliphatic rings or heterocyclic rings.

The light-sensitive materials of the invention can be incorporated with a developing agent. Examples of usable developing agents include those described in *Research Disclosure,* Vol. 176, p. 29, under the heading "Developing Agents".

Photographic emulsion layers and other layers in the light-sensitive materials of the invention can be incorporated with filtering dyes, as well as other dyes used for various purposes including the prevention of irradiation. Examples of dyes usable for such purposes include those described in *Research disclosure,* Vol. 176, p. 25–26, under the heading "Absorbing and filter dyes".

The light-sensitive materials of the invention can be additionally incorporated with antistatic agents, plasticizers, matting agents, lubricants, UV absorbers, whitening agents, aerial fog-preventing agents, or the like.

The silver halide photographic emulsion layers and/or other layers constituting the light-sensitive materials of the invention are coated on a support. Coating of such layers can be conducted according to methods described in *Research Disclosure,* Vol. 176, p. 27–28, under the heading "Coating procedures".

Examples of preferable layer structure for the color reversal light-sensitive material of the invention are as follows:

Layer Structure 1

Upon a support are formed, in order, a red-sensitive emulsion layer, an interlayer, a green-sensitive emulsion layer, a yellow filter layer, a blue-sensitive emulsion layer, and optionally a protective layer, at least one of said red-sensitive and blue-sensitive emulsion layers having a silver/coupler ratio smaller by a factor of at least 5 than that in said green-sensitive emulsion layer and at least one of said emulsion layers with smaller silver/coupler ratio being incorporated with a compound according to the invention.

Layer Structure 2

Upon a support are formed the same layers as in Layer Structure 1 above, except that said interlayer between said red-sensitive emulsion layer and said green-sensitive emulsion layer is incorporated with fogged silver halide grains.

Layer Structure 3

Upon a support are formed the same layers as in Layer Structure 2 above, except that a fog-prevention layer (a gelatin layer not containing fogged silver halide grains) is additionally formed between said red-sensitive emulsion layer and said interlayer containing fogged silver halide grains.

Layer Structure 4

Upon a support are formed a slow speed (or low sensitive) red-sensitive emulsion layer, an interlayer (optional), a high speed (or high sensitive) red-sensitive emulsion layer, an interlayer, a slow speed green-sensitive emulsion layer, an interlayer (optional), a high speed green-sensitive emulsion layer, a yellow filter layer, a slow speed blue-sensitive emulsion layer, an interlayer (optional), a high speed blue-sensitive emulsion layer and a protective layer (optional), at least one of said slow speed blue-sensitive and red-sensitive emulsion layers having a silver/coupler ratio smaller by a factor of at least 5 than that in said slow speed green-sensitive emulsion layer and at least one of said slow-speed emulsion layers with smaller silver/coupler ratios being incorporated with a compound according to the invention.

Layer Structure 5

Upon a support are formed the same layers as in Layer Structure 4 above, except that said interlayer between said high speed red-sensitive emulsion layer and said slow speed green-sensitive emulsion layer is incorporated with fogged silver halide grains.

Layer Structure 6

Upon a support are formed the same layers as in layer Structure 5 above, except that a fog-prevention layer (a layer not containing fogged silver halide grains) is additionally formed between said high speed red-sensitive emulsion layer and said interlayer containing fogged silver halide grains.

Layer Structure 7

Upon a support are formed the same layers as in Layer Structure 2, 3, 5 or 6, except that said red-sensitive emulsion layer(s) is (are) spectrally sensitized with a red-sensitizing dye having at least two water-soluble groups.

Layer Structure 8

Upon a support are formed the same layers as in Layer Structure 2, 3, 5 or 6, wherein the said fogged silver halide grains are incorporated into said interlayer at a coverage of 5 to 500 mg/m$^2$.

Layer Structure 9

Upon a support are formed the same layers as in Layer Structure 4, 5 or 6, wherein the silver/coupler ratio in said slow speed red-sensitive emulsion layer is from 5 to 50, in particular, from 5 to 40; the silver/coupler ratio in said high speed red-sensitive layer is from 5 to 20, in particular, from 5 to 15; the silver/coupler ratio in said slow speed green-sensitive emulsion layer is from 10 to 100, in particular, from 10 to 70; the silver/coupler ratio in said high speed green-sensitive emulsion layer is from 5 to 20, in particular, from 5 to 15; the silver/coupler ratio in said slow speed blue-sensitive emulsion layer is from 5 to 50, in particular, from 5 to 40; and the silver/coupler ratio in said high speed blue-sensitive emulsion layer is from 5 to 20, in particular, from 5 to 15.

Of the layer structures mentioned above, those according to Layer Structures 4 to 9 (in cases of Layer Structure 7 and 8, those according to Layer Structure 5 or 6) can be preferable.

The color reversal light-sensitive materials are usually subjected to a processing consisting basically of the following steps: Black-and-white development (first development)→Stopping→Washing→Reversal→Washing→Color developing→Stopping→Washing→Compensating→Washing→Bleaching→Washing→Stabilizing→Drying.

To this processing, there may be added prebath, prehardening bath, neutralizing bath, etc. The washing steps, which follow the stopping, reversal, color developing, compensating and bleaching steps, can be omitted. The reversal step can be substituted with reexposure, or can be omitted by incorporating a fogging agent into the bath for the color development. The compensating step can also be excluded.

The present invention will further be illustrated by example.

EXAMPLE

Onto a triacetate film base were coated, in order, the following layers.

1st Layer: Antihalation layer

A layer of gelatin containing black colloidal silver

2nd Layer: Gelatin interlayer

3rd Layer: Slow speed red-sensitive emulsion layer

A layer of gold and sulfur sensitized slow speed silver iodobromide emulsion having a silver iodide content of 3.6 mol% and an average grain size of ca. 0.3μ and incorporated with a sensitizing dye:

3,3'-di(3-sulfopropyl)-9-ethylnaphto(1,2-d)thiacarbocyanine and a cyan coupler emulsion consisting of:

2-(heptafluorobutylamido)-5-{2'-(2'',4''-di-t-aminophenoxybutylamido}phenol (coupler); and tricresyl phosphate (coupler solvent).

This layer had a silver/coupler ratio of 17.0 and a silver coverage of 0.9 g/m$^2$.

4th Layer: High speed red-sensitive emulsion layer

A layer of gold and sulfur sensitized high speed silver iodobromide emulsion having a silver iodide content of 3.5 mol% and an average grain size of ca. 0.6μ and incorporated with the same sensitizing dye and cyan coupler emulsion as in said 3rd Layer. This layer had a silver coverage of 0.4 g/m$^2$.

5th Layer: Gelatin interlayer

6th Layer: Interlayer

A layer of prefogged silver bromide emulsion containing grains with foggs on the surface thereof and having an average grain size of ca. 0.15μ. This layer had a silver coverage of 0.03 g/m$^2$ and a gelatin coverage of 0.4 g/m$^2$.

7th Layer: Slow speed green-sensitive emulsion layer

A layer of gold and sulfur sensitized slow speed silver iodobromide emulsion having a silver iodide content of 3 mol% and an average grain size of ca. 0.3μ and incorporated with a sensitizing dye:

sodium salt of 5,5'-diphenyl-9-ethyl-3,3'-disulfopropyloxacarbocyanine and a magenta coupler emulsion consisting of:

1-(2,4,6-trichlorophenyl)-3-[3-(2,2-di-t-aminophenoxyacetamido)benzamido]-5-pyrazolone (coupler); and tricresyl phosphate (coupler solvent)

This layer had a silver/coupler ratio of 30.0 and a silver coverage of 1.0 g/m$^2$.

8th Layer: High speed green-sensitive emulsion layer

A layer of gold and sulfur sensitized high speed silver iodobromide emulsion having a silver iodide content of 2.6 mol% and an average grain size of ca. 0.9μ and incorporated with the same sensitizing dye and magenta coupler emulsion as in the 7th layer described above. This layer has a silver coverage of 0.6 g/m$^2$.

9th Layer: Gelatin interlayer

10th Layer: Yellow filter layer

A layer of gelatin containing yellow colloidal silver.

11th Layer: Slow speed blue-sensitive emulsion layer

A layer of gold and sulfur sensitized silver iodobromide emulsion having a silver iodide content of 4 mol% and an average grain size of ca. 0.4μ and incorporated with a yellow coupler emulsion consisting of:

α-(4-pivaloyl)-α-(1-benzyl-5-ethoxy-3-hydantoinyl)-2-chloro-5-dodecyloxycarbonylacetanilide (coupler); and tricresyl phosphate (coupler solvent).

This layer had a silver/coupler ratio of 13.0 and a silver coverage of 0.9 g/m$^2$.

12th Layer: High speed blue-sensitive emulsion layer

A layer of gold and sulfur sensitized high speed silver iodobromide emulsion layer having a silver iodide content of 2.6 mol% and an average grain size of ca. 1.0μ and incorporated with the same yellow coupler emulsion as in 11th Layer described above.

This layer had a silver coverage of 0.6 g/m$^2$.

13th Layer: Protective gelatin layer

Upon coating, each of the above-mentioned layers was additionally incorporated with: 4-hydroxy-6-methyl-1,3,3a,7-tetrazaindene (stabilizer); 1,2-bis(vinylsulfonylacetamido)ethane (hardener); sodium p-dodecylbenzenesulfonate (coating aid); and sodium p-nonylphenoxypoly(ethylenoxy)propanesulfonate (coating aid).

The thus prepared color reversal photographic light-sensitive material (control sample) is designated as Sample 1.

Sample 2 (according to the invention) was prepared in the same manner as in the preparation of Sample 1, except that said slow speed blue-sensitive emulsion layer was additionally incorporated with Compound 1 shown herreinbefore (which was prepared according to Synthesis Example 1 in Japanese Patent Publication No. 15471/71 which corresponds to U.S. Pat. No. 3,622,339) in an amount of 0.3 g, per mole of silver contained in said emulsion layer.

Sample 3 (according to the invention) was prepared in the same manner as in the preparation of Sample 1, except that the said slow speed blue-sensitive emulsion layer was additionally incorporated with said Compound 1 in an amount of 0.7 g, per mole of silver contained in said emulsion layer.

Sample 4 (according to the invention) was prepared in the same manner as in the preparation of Sample 1, except that said slow speed red-sensitive emulsion layer was additionally incorporated with the said Compound 1 in an amount of 0.4 g, per mole of silver contained in said emulsion layer.

Sample 5 (according to the invention) was prepared in the same manner as in the preparation of Sample 3, except that said slow speed red-sensitive emulsion layer was additionally incorporated with the said Compound 1 in an amount of 0.4 g, per mole of silver contained in said emulsion layer.

Samples 1 to 5 were exposed through an optical wedge and then subjected to color reversal processing in accordance with processing Prescriptions 1, 2, 3, 4 and 5 of the following:

Processing Prescription 1:

| Processing Steps: | Time (min.) | Temperature (°C.) |
|---|---|---|
| First Development | 6 | 38 |
| Washing | 2 | " |
| Reversal | 2 | " |
| Color development | 6 | " |
| Compensating | 2 | " |
| Bleaching | 6 | " |
| Fixing | 4 | " |
| Washing | 4 | " |
| Stabilizing | 1 | Ordinary temperature |
| Drying | | |

For the above processing steps were used the following processing solutions:

| | |
|---|---|
| First developer | |
| Water | 700 ml |
| Sodium tetrapolyphosphate | 2 g |
| Sodium sulfite | 20 g |
| Hydroquinone.monosulfonate | 30 g |
| Sodium carbonate (monohydrate) | 30 g |
| 1-phenyl-4-methyl-4-hydroxymethyl-3-pyrazolidone | 2 g |
| Potassium bromide | 0.63 g |
| Potassium thiocyanate | 1.2 g |
| Potassium iodide (0.1% solution) | 2 ml |
| Water to make | 1000 ml |
| (pH was adjusted at 10.1) | |
| Reversal solution | |
| Water | 700 ml |
| Hexasodium nitro-N,N,N—trimethylene phosphonate | 3 g |
| Stannous chloride (dihydrate) | 1 g |
| p-aminophenol | 0.1 g |
| Sodium hydroxide | 8 g |
| Glacial acetic acid | 15 ml |
| Water to make | 1000 ml |
| Color developer | |
| Water | 700 ml |
| Sodium tetrapolyphosphate | 2 g |
| Sodium sulfite | 7 g |
| Sodium tertiary phosphate (12 hydrate) | 36 g |
| Potassium bromide | 1 g |
| Potassium iodide (0.1% solution) | 90 ml |
| Sodium hydroxide | 3 g |
| Citrazinic acid | 15 g |
| N—ethyl-N—(β-methanesulfonamidoethyl)-3-methyl-4-aminoaniline sulfate | 11 g |
| Ethylenediamine | 3 g |
| Water to make | 1000 ml |
| Compensation solution | |
| Water | 700 ml |
| Sodium sulfite | 12 g |
| Sodium ethylenediaminetetraacetate (2 $H_2O$) | 8 g |

-continued

| | |
|---|---|
| Thioglycerol | 0.4 ml |
| Glacial acetic acid | 3 ml |
| Water to make | 1000 ml |
| Bleaching solution | |
| Water | 800 ml |
| Sodium ethylenediaminetetraacetate (2 $H_2O$) | 2 g |
| Iron (III) ammonium ethylenediaminetetra-acetate (2 $H_2O$) | 120 g |
| Potassium bromide | 100 g |
| Water to make | 1000 ml |
| Fixing solution | |
| Water | 800 ml |
| Ammonium thiosulfate | 80 g |
| Sodium sulfite | 5 g |
| Sodium bisulfate | 5 g |
| Water to make | 1000 ml |
| Stabilizing solution | |
| Water | 800 ml |
| Formalin (37 wt %) | 5 ml |
| Fuji Driwel | 5 ml |
| Water to make | 1000 ml |

Processing Prescription 2:

Identical with the above-described Processing Prescription 1, except that the amount of potassium bromide used in the first developer was increased to 1.25 g.

Processing Prescription 3:

Identical with the above-described Processing Prescription 1, except that the amount of potassium bromide used in the first developer was increased to 2.5 g.

Processing Prescription 4:

Identical with the above-described Processing Prescription 1, except that the amount of potassium bromide used in the first developer was increased to 5.0 g.

Densities of yellow, magenta and cyan images in each sample were measured, and sensitivities of each sample were determined therefrom. Differences in sensitivities between samples processed in accordance with Processing Prescription 3 and those processed in accordance with other Processing Prescriptions are shown in Table 1.

TABLE 1

| | Amount of Compound 1 Added (g/per mole silver) | | | Difference in Sensitivity | | |
|---|---|---|---|---|---|---|
| Sample | 3rd Layer | 11th Layer | Processing Prescription | Yellow | Magenta | Cyan |
| Sample 1* | 0 | 0 | 1 | +0.20 | +0.06 | +0.19 |
| | | | 2 | +0.10 | +0.04 | +0.08 |
| | | | 3 | 0 | 0 | 0 |
| | | | 4 | −0.04 | −0.01 | −0.06 |
| Sample 2** | 0 | 0.3 | 1 | +0.16 | +0.07 | +0.18 |
| | | | 2 | +0.08 | +0.04 | +0.08 |
| | | | 3 | 0 | 0 | 0 |
| | | | 4 | −0.02 | −0.02 | −0.07 |
| Sample 3** | 0 | 0.7 | 1 | +0.08 | +0.06 | +0.19 |
| | | | 2 | +0.05 | +0.04 | +0.08 |
| | | | 3 | 0 | 0 | 0 |
| | | | 4 | −0.02 | −0.01 | −0.06 |
| Sample 4** | 0 | 0 | 1 | +0.20 | +0.06 | +0.06 |
| | | | 2 | +0.09 | +0.04 | +0.04 |
| | | | 3 | 0 | 0 | 0 |
| | | | 4 | −0.04 | −0.01 | −0.02 |
| Sample 5** | 0.4 | 0.7 | 1 | +0.07 | +0.06 | +0.07 |
| | | | 2 | +0.04 | +0.04 | +0.04 |
| | | | 3 | 0 | 0 | 0 |
| | | | 4 | −0.02 | −0.02 | −0.02 |

Notes:
*Control sample;
**Sample according to the invention

Table 1 shows that the variations in the yellow sensitivities in Samples 2 and 3, the slow speed blue-sensitive emulsions of which are incorporated with Compound 1 according to the invention, are apparently smaller than that of Sample 1, or the control sample.

The table also shows that the variation in the cyan sensitivity in Sample 4, the slow speed red-sensitive emulsion layer of which is incorporated with Compound 1 according to the invention, is apparently smaller than that of Sample 1, or the control sample. It is also shown in the table that the variation in the yellow and cyan sensitivities in Sample 5, of which slow speed blue-sensitive emulsion layer and slow red-sensitive emulsion layer are incorporated with Compound 1 according to the invention, is apparently smaller than that in Sample 1, or the control sample. It would therefore be obvious that the objection of the invention, namely, the prevention of deterioration in color balance due to the variation in the density of potassium bromide contained in the first developer could be attained in samples according to the invention.

While the invention has been described in detail and with reference to specific embodiments thereof, it will be apparent to one skilled in the art that various changes and modifications can be made therein without departing from the spirit and scope thereof.

What is claimed is:

1. A color reversal light-sensitive material comprising a support having coated thereon at least a pair of silver halide emulsion layers having mutually different color sensitivities and consisting of an emulsion having a high silver/coupler ratio (A) and an emulsion having a low silver/coupler ratio (B), wherein (A)−(B)≧5 and wherein only the latter emulsion contains a compound containing recurring units represented by the following General Formula (I):

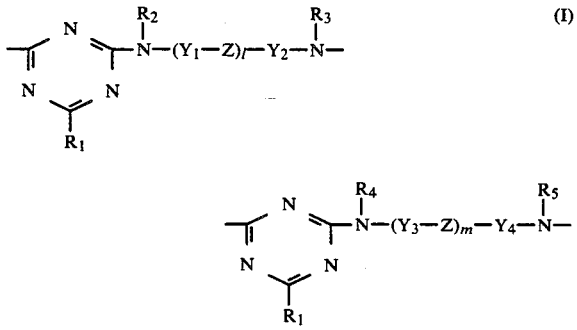

(I)

wherein:

$R_1$ represents —OR, —SR or

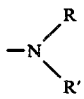

in which R and R′ each represents a hydrogen atom, an alkyl, substituted alkyl, aryl, substituted aryl, aralkyl, substituted aralkyl, cycloalkyl, substituted cycloalkyl, heterocyclic or substituted heterocyclic group, or R and R′ in combination form a heterocyclic ring or a heterocyclic ring containing an —O— group;

$R_2$, $R_3$, $R_4$ and $R_5$ each represents a hydrogen atom, an alkyl group or a substituted alkyl group;

$Y_1$, $Y_2$, $Y_3$ and $Y_4$ each represents a polymethylene group, a substituted polymethylene group, an aryl group, a substituted aryl group or a cycloalkylene group;

Z represents —O—, —$SO_2$— or —$CH_2$—; and l and m represent 0 or an integer of 1.

2. A color reversal light-sensitive material as claimed in claim 1, wherein (A)−(B)≧10.

3. A color reversal light-sensitive material as claimed in claim 2, wherein $R_1$ is —OR, —SR or

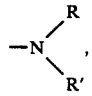

wherein R and R′ are each hydrogen atom, an alkyl, hydroxyalkyl, sulfoalkyl or the salt thereof, carboxyalkyl or the salt thereof, aralkyl, or cycloalkyl group each having up to 12 carbon atoms, a 5- or 6-membered heterocyclic residue, a 5- or 6-membered condensed heterocyclic residue, an aryl group which contains 6 to 12 carbon atoms or an aryl group which contains 6 to 12 carbon atoms substituted with a sulfo group or the salt thereof, a carboxyl group or the salt thereof, an alkyl group having 1 to 4 carbon atoms or a halogen atom; or R and R′ in combination form a heterocyclic ring or a heterocyclic ring containing an —O— group.

4. A color reversal light-sensitive material as claimed in claim 3, wherein $R_2$, $R_3$, $R_4$ and $R_5$ each represent a hydrogen atom, an alkyl group containing 1 to 4 carbon atoms, or an alkyl group containing 1 to 4 carbon atoms substituted with a hydroxyl group.

5. A color-reversal light-sensitive material as claimed in claim 4, wherein $Y_1$, $Y_2$, $Y_3$ and $Y_4$ each is a polymethylene group having 2 to 12 carbon atoms; a polymethylene group having 2 to 12 carbon atoms which is substituted with an alkaline group having 1 to 4 carbon atoms; an arylene group; an arylene group substituted with a sulfo group or the salt thereof, a carboxyl group or the salt thereof, an alkyl group having 1 to 4 carbon atoms or a halogen atom; or a cycloalkyl group.

6. A color reversal light-sensitive material as claimed in claim 1, wherein the compound of general formula (I) is present in an amount in the range of 0.01 to 50 g per mole of silver halide contained in the silver halide emulsion layer into which the compound is incorporated.

7. A color reversal light-sensitive material as claimed in claim 6, wherein the compound of general formula (I) is present in an amount in the range of 0.1 to 40 g per mole of silver halide.

8. A color reversal light-sensitive material as claimed in claim 7, wherein the compound of general formula (I) is present in an amount in the range of 0.1 to 5 g per mole of silver halide.

9. A color reversal light-sensitive material as claimed in claim 1, wherein an interlayer containing fogged silver halide grains is provided between said pair of silver halide emulsion layers having mutually different color sensitivities and consisting of an emulsion having a high silver/coupler ratio and an emulsion having a low silver/couple ratio.

10. A color reversal light-sensitive material as claimed in claim 9, wherein upon a support at least the silver halide emulsion layer consisting of an emulsion having a low silver/coupler ratio, a fog-prevention layer (a gelatin layer not containing fogged silver halide grains), the interlayer containing fogged silver halide grains and the silver halide emulsion layer consisting of an emulsion having a high silver/coupler ratio are provided in this order, said two silver halide emulsion layers having mutually different color sensitivity.

11. A color reversal light-sensitive material as claimed in claim 9, wherein the silver halide emulsion layer consisting of an emulsion having a high silver/coupler ratio has a green sensitivity and the silver halide emulsion layer consisting of an emulsion having a low silver/coupler ratio has a red sensitivity.

12. A color reversal light-sensitive material as claimed in claim 10, wherein the silver halide emulsion layer consisting of an emulsion having a high silver/coupler ratio has a green sensitivity and the silver halide emulsion layer consisting of an emulsion having a low silver/coupler ratio has a red sensitivity.

* * * * *